US007934627B2

(12) United States Patent
Sample et al.

(10) Patent No.: US 7,934,627 B2
(45) Date of Patent: May 3, 2011

(54) APPARATUS AND METHOD FOR HIGH PRESSURE EXTRUSION WITH MOLTEN ALUMINUM

(75) Inventors: Vivek M. Sample, Murrysville, PA (US); David E. Gaylord, Muskegon, MI (US); Vincent A. Paola, Jeannette, PA (US); Domenic A. Ghiardi, Avonmore, PA (US); Ronald G. Chabal, New Kensington, PA (US); Jacob A. Kallivayalil, Pittsburgh, PA (US)

(73) Assignee: Alcoa Inc., Pittsburgh, PA (US)

( * ) Notice: Subject to any disclaimer, the term of this patent is extended or adjusted under 35 U.S.C. 154(b) by 724 days.

(21) Appl. No.: 11/548,726

(22) Filed: Oct. 12, 2006

(65) Prior Publication Data

US 2008/0087691 A1 Apr. 17, 2008

Related U.S. Application Data

(60) Provisional application No. 60/726,280, filed on Oct. 13, 2005.

(51) Int. Cl.

| | |
|---|---|
| ***B22D 11/10*** | (2006.01) |
| ***B22D 15/02*** | (2006.01) |
| *B67D 5/18* | (2006.01) |

(52) U.S. Cl. ..... 222/596; 222/591; 222/594; 222/595; 164/303; 164/312; 164/315; 164/317; 164/488

(58) Field of Classification Search ..... 222/591, 222/594–596; 164/303, 312, 315, 317, 488
See application file for complete search history.

(56) References Cited

U.S. PATENT DOCUMENTS

| | | | |
|---|---|---|---|
| 1,587,933 | A | 6/1926 | Barme |
| 1,850,668 | A | 3/1932 | Harris |
| 1,924,294 | A | 8/1933 | Shirk et al. |
| 3,103,713 | A | 9/1963 | Ahlgren |
| 3,224,240 | A | 12/1965 | Muller |
| 3,328,994 | A | 7/1967 | Lindemann |
| 3,574,341 | A | 4/1971 | Fehling et al. |
| 3,625,045 | A | 12/1971 | Riemann |
| 3,861,848 | A | 1/1975 | Weingarten |
| RE28,795 | E | 5/1976 | Fuchs, Jr. |
| 4,044,587 | A | 8/1977 | Green et al. |
| 4,054,048 | A | 10/1977 | Hagerman |
| 4,075,881 | A | 2/1978 | Kreidler |
| 4,393,917 | A | 7/1983 | Fuchs, Jr. |

(Continued)

FOREIGN PATENT DOCUMENTS

| | | |
|---|---|---|
| CA | 2453170 | 6/2004 |

(Continued)

OTHER PUBLICATIONS

Search report from corresponding Eurasian Patent Application No. 200801070.

(Continued)

*Primary Examiner* — Roy King
*Assistant Examiner* — Lois Zheng
(74) *Attorney, Agent, or Firm* — Greenberg Traurig LLP

(57) ABSTRACT

This invention discloses a molten metal supply system that can supply molten metal to a downstream process at a constant pressure and molten metal flow rate. The molten metal supply system includes a molten metal supply source, a plurality of injectors, and a plurality of check valves.

8 Claims, 8 Drawing Sheets

U.S. PATENT DOCUMENTS

| | | | | |
|---|---|---|---|---|
| 4,425,775 | A | 1/1984 | Fuchs, Jr. | |
| 4,445,350 | A | 5/1984 | Nishihara et al. | |
| 4,601,325 | A | 7/1986 | Maddock | |
| 4,718,476 | A | 1/1988 | Eibe | |
| 4,730,660 | A | 3/1988 | Tinnes et al. | |
| 4,730,935 | A | 3/1988 | Kolossow | |
| 4,774,997 | A | 10/1988 | Eibe | |
| 4,793,596 | A | 12/1988 | Kubota et al. | |
| 5,015,438 | A | 5/1991 | Ashok et al. | |
| 5,015,439 | A | 5/1991 | Tyler et al. | |
| 5,090,471 | A | 2/1992 | Wilson | |
| 5,092,499 | A | 3/1992 | Sodderland | |
| 5,152,163 | A | 10/1992 | Hawkes et al. | |
| 5,157,955 | A | 10/1992 | Hawkes et al. | |
| 5,377,744 | A | 1/1995 | Maddock | |
| 5,383,347 | A | 1/1995 | Riviere et al. | |
| 5,407,000 | A | 4/1995 | Mercer, II et al. | |
| 5,431,213 | A | 7/1995 | Jouet-Pastre | |
| 5,443,187 | A | 8/1995 | Samuelson | |
| 5,454,423 | A | 10/1995 | Tsuchida et al. | |
| 5,494,262 | A | 2/1996 | McLane et al. | |
| 5,568,766 | A | 10/1996 | Otremba et al. | |
| 5,591,248 | A | 1/1997 | Jafs et al. | |
| 5,595,085 | A | 1/1997 | Chen | |
| 5,598,731 | A | 2/1997 | Riviere et al. | |
| 5,850,870 | A | 12/1998 | Wagstaff et al. | |
| 6,436,320 | B1 | 8/2002 | Kazmer et al. | |
| 6,505,674 | B1 | 1/2003 | Sample et al. | |
| 6,536,508 | B1 * | 3/2003 | Sample et al. | 164/488 |
| 6,563,508 | B1 | 5/2003 | Oka | |
| 6,708,752 | B2 | 3/2004 | Sample et al. | |
| 6,712,125 | B2 | 3/2004 | Sample et al. | |
| 6,712,126 | B2 * | 3/2004 | Sample et al. | 164/488 |
| 6,739,485 | B2 | 5/2004 | Sample et al. | |
| 2003/0056934 | A1 | 3/2003 | Sample et al. | |
| 2004/0017029 | A1 | 1/2004 | Sample et al. | |

FOREIGN PATENT DOCUMENTS

| | | |
|---|---|---|
| CN | 1008595 | 5/1987 |
| CN | 1526494 | 9/2004 |
| DE | 4136066 | 5/1993 |
| DE | 4326325 | 2/1995 |
| EP | 0053510 | 5/1985 |
| EP | 0223078 | 5/1987 |
| GB | 484006 | 4/1938 |
| GB | 2156253 | 10/1985 |
| JP | 52-101656 | 8/1977 |
| JP | 53-115653 | 10/1978 |
| JP | 53-137062 | 11/1978 |
| JP | 54-110127 | 8/1979 |
| JP | 55128509 | 10/1980 |
| JP | 60-242023 | 12/1985 |
| JP | 63-199016 | 8/1988 |
| JP | 04-111956 | 4/1992 |
| JP | 05-115957 | 5/1993 |
| JP | 07-051827 | 2/1995 |
| JP | 07265937 | 10/1995 |
| JP | 11-239857 | 9/1999 |
| JP | 11-347720 | 12/1999 |
| RU | 2161546 | 1/2001 |
| SU | 83705 | 1/1950 |
| WO | 02/085556 | 10/2002 |
| WO | 02/085557 | 10/2002 |
| WO | 02/085560 | 10/2002 |

OTHER PUBLICATIONS

Office Action dated Feb. 6, 2009 relating to corresponding Chinese Application for Invention No. 200680037967.0.

Chinese Office Action from Chinese Application No. 10067884.8 dated Jul. 25, 2008.

European Office Action from European Application No. 02764237.0 dated Jun. 22, 2004.

European Office Action from European Application No. 02764237.0 dated Jan. 12, 2005.

European Office Action from European Application No. 06010464.3 dated Sep. 15, 2006.

European Office Action from European Application No. 06010464.3 dated Jun. 1, 2007.

International Search Report from International Application No. PCT/US03/26059 dated Feb. 25, 2004.

International Search Report from International Application No. PCT/US01/42261 dated May 22, 2002.

Russian Office Action from Russian Application No. 2003133665 dated Apr. 11, 2006.

International Search Report from International Application No. PCT/US02/12362 dated Jul. 14, 2003.

Japanese Office Action from Japanese Application No. 2005-181807 dated Nov. 25, 2008.

Japanese Office Action from Japanese Application No. 2002-583122 dated Aug. 12, 2009.

* cited by examiner

APPARATUS AND METHOD FOR HIGH PRESSURE EXTRUSION WITH MOLTEN ALUMINUM

CROSS REFERENCE TO RELATED APPLICATIONS

This application is based on and claims the benefit of U.S. provisional application Ser. No. 60/726,280, filed Oct. 13, 2005.

FIELD OF THE INVENTION

This invention relates to a molten metal supply system. Specifically, is invention relates to a continuous pressure molten metal supply system and method of extruding an article of indefinite length.

BACKGROUND OF THE INVENTION

The metal working process known as extrusion involves pressing metal stock (ingot or billet) through a die opening having a predetermined configuration in order to form a shape having a longer length and a substantially constant cross-section. For example, in the extrusion of aluminum alloys, the aluminum stock is preheated to the proper extrusion temperature. The aluminum stock is then placed into a heated cylinder. The cylinder utilized in the extrusion process has a die opening at one end of the desired shape and a reciprocal piston or ram having approximately the same cross-sectional dimensions as the bore of the cylinder. This piston or ram moves against the aluminum stock to compress the aluminum stock. The opening in the die is the path of least resistance for the aluminum stock under pressure. The aluminum stock deforms and flows through the die opening to produce an extruded product having the same cross-sectional shape as the die opening.

Referring to FIG. 1, the foregoing described extrusion process is identified by reference numeral 2, and typically consists of several discrete and discontinuous operations including: melting 4, casting 6, scalping 8, homogenizing 10, optionally sawing 12, reheating 14, and finally, extrusion 16. The aluminum stock is cast at an elevated temperature and typically cooled to room or ambient temperature. After casting, the aluminum stock is scalped to remove the oxide layer that naturally forms on the surface of the aluminum stock due to the reaction between the aluminum surface and the oxygen in the atmosphere. Because the aluminum stock is cast, there is a certain amount of inhomogeniety in the structure of the aluminum stock. Therefore, the aluminum stock is typically heated at elevated temperatures to homogenize the cast metal. Following the homogenization step, the aluminum stock is cooled to room temperature. After cooling, the homogenized aluminum stock is reheated in a furnace to an elevated temperature called the preheat temperature. Those skilled in the art will appreciate that the preheat temperature is generally the same for each billet that is to be extruded in a series of billets. Upon reaching the preheat temperature, the aluminum stock is placed in an extrusion press and extruded through the extrusion die to form an extruded product.

All of the foregoing steps relate to practices that are well known to those skilled in the art of casting and extruding. Each of the foregoing steps is related to metallurgical control of the metal to be extruded. These steps are very cost intensive, with energy costs incurring each time the metal stock is reheated from room temperature. There are also in-process recovery costs associated with the need to trim the metal stock, labor costs associated with process inventory, and capital and operational costs for the extrusion equipment.

Therefore, there exists a need to consolidate the discrete and discontinuous operations of a traditional extrusion process to reduce the cost of manufacturing an extruded product.

Previous attempts to develop a continuous extrusion process are described in U.S. Pat. Nos. 6,536,508, 6,712,126 and 6,739,485 by Sample et al. These patents are incorporated by reference. Also, these patents describe a system for extruding an article in a continuous fashion accomplished by using multiple injectors of molten metal operating sequentially. Each of the injector is connected between the source of molten metal and the downstream process. Accurate synchronization is required between the multiple injectors for successful operation. The synchronization is achieved by means of valves that open or close to facilitate or impede the flow of molten aluminum. The reliability and ease of operation of these valves is crucial to the success of these inventions.

While these patents provide a continuous process it is desirable to provide an apparatus and continuous method of extrusion that consolidates the multiple operations of a traditional extrusion process into a single operation. The operation of the invention disclosed here is significantly more reliable than previous inventions to achieve the same goal. The improved reliability is a result of the simplification of certain components and due to the invention of additional components that reduce the complexity of tasks involved in continuously extruding an article.

SUMMARY OF THE INVENTION

Generally speaking in accordance with the invention a molten metal supply system capable of supplying metal continuously to a downstream shaping operation at a constant pressure or velocity is provided. The molten metal supply system includes a plurality of molten metal injectors with at least one molten metal injector referred to here after as the feed cylinder (FC) connected directly to the metal source and a second molten metal injector referred to as the accumulator cylinder (AC) connected to the first injector and the downstream process. The system also includes a low pressure molten metal feed system and a process control cylinder referred to hereafter as the (PCC).

The FC and AC injectors are linked to each other and a low pressure molten metal feed system by a plurality of check valves to facilitate or impede the flow of molten metal between different components of the molten metal delivery system. A first check valve referred to hereafter as the inlet check valve (ICV) links the low pressure feed system to the feed cylinder (CC) molten metal injector. A second check valve referred to as the outlet check valve (OCV) links the (FC) molten metal injector and the (AC) molten metal injector. The molten metal injectors TIC, AC), check valves (ICV, OCV) and process control cylinder (PCC) act in conjunction to supply molten metal from the low pressure feed system to a downstream shaping operation continuously such that the supplied molten metal is at a constant pressure or a constant product velocity is maintained.

Each of the molten metal injectors have an injector housing configured to contain molten metal and a piston that is reciprocally operable within the injector housing. A forward stroke of the piston displaces fluid from the injector housing allowing the injector to feed molten metal and a return stroke of the piston allows the injector housing to fill with metal. Each of the injectors use the gas over metal-moving piston concept as described in U.S. Pat. No. 6,739,485 by Sample et al.

Control of the flow of molten metal and exit speed of the product is accomplished by a process control cylinder (PCC) which gaseous communication with the (AC) molten metal injector. The process control cylinder has a separate housing configured to contain gas and a piston that is reciprocally modulated within the housing. The piston is movable through a forward stroke and a return stroke. The return stoke of the PCC enables the gas to expand thereby decreasing the pressure in the AC molten metal injector housing resulting in a decrease in the exit speed of the product. The forward stroke of the PCC compresses the gas thereby increasing the pressure in the AC molten metal injector housing resulting in an increase in the speed of the product. The PCC piston position can thus be modulated to maintain a target speed.

A method of operating a molten metal supply system to supply molten metal to a downstream process at a substantially constant molten metal flow rate or pressure is also provided. The method includes actuating the injector pistons such that the injector housing fills with molten metal and subsequently feeds the molten metal to another injector or to a downstream process. When an injector is feeding metal it is referred to as being in the feed or extrude stage and when it is being filled with metal it is referred to as being in the fill stage. The molten metal supply system operates in a cyclical fashion with a single cycle being defined by the FC molten metal injector going through a fill stage and a feed stage. The FC molten metal injector, during its fill stage, is in fluid communication with the molten metal supply source or vessel (by opening the ICV and closing the OVC) and during the feed stage, it is in fluid communication with the AC molten metal injector and the downstream process (by opening the OCV and closing the ICV). The gas in the feed cylinder is prepressurized to the pressure in the AC prior to the feed stage. During the feed stage, the gas pad in the FC cylinder is compressed further to facilitate the transfer of molten aluminum from the FC to the AC. At this stage the FC supplies molten metal to the AC cylinder and the downstream process. This results in filling the AC. The forward stroke of the FC molten metal injector is operated at a higher speed which results in simultaneously feeding of molten metal to the accumulator cylinder (AC) and the downstream process. The piston of the AC is always slaved to the molten metal level in the AC to maintain a constant gas pad. Consequently, the FC and the AC molten metal injector pistons will move in opposite directions such that when one is feeding the other is filling. Prior to the return stroke of the FC, the OCV is closed and the gas in the FC is vented.

Controlling the exit speed of a product from the downstream process is accomplished by adjusting the pressure in the AC molten metal injector with a process control cylinder (PCC), which is in gaseous communication with the AC molten metal injector. The PCC piston is modulated based on feedback from the product velocity sensor.

The check valves operate by freezing and thawing molten metal in a passage way to respectively impede or facilitate the flow of molten metal. These valves provide a reliable means of isolating components when they are operating at substantially different working pressures.

Another aspect of the present invention is to reduce the total amount of costs associated with manufacturing an extruded product.

BRIEF DESCRIPTION OF THE DRAWINGS

For a fuller understanding of the invention, reference is made to the following description taken in connection with the accompanying drawing(s), in which.

DETAILED DESCRIPTION OF PREFERRED EMBODIMENTS

Figure 1:
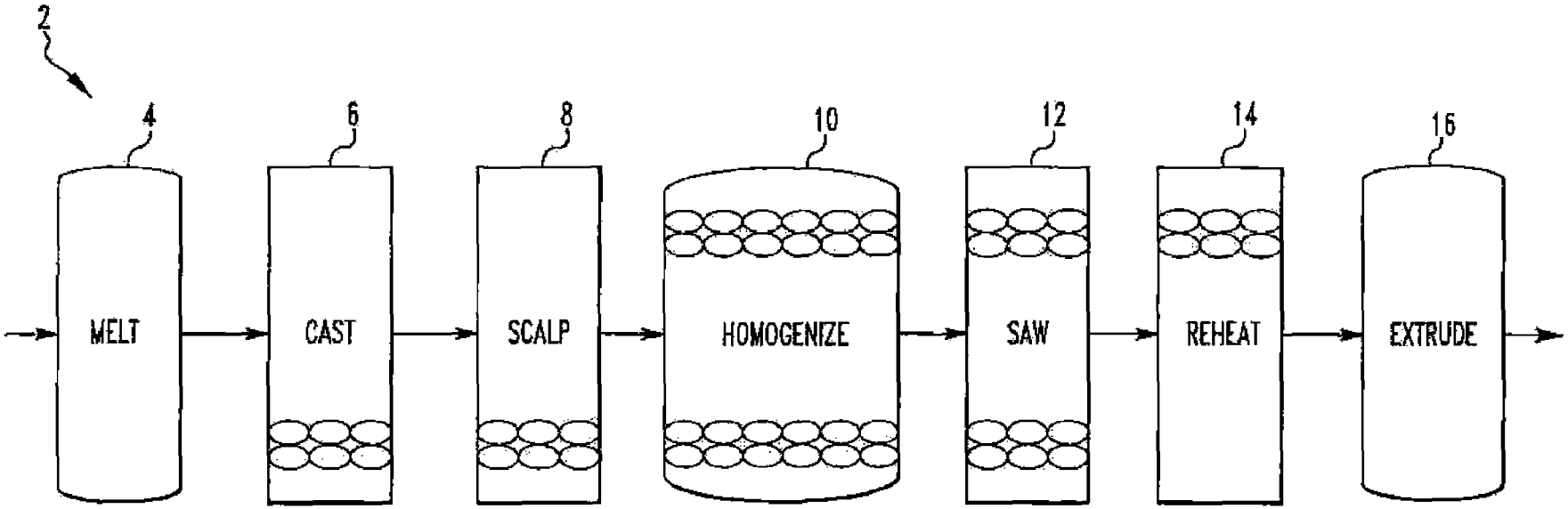
FIG. 1 PRIOR ART
FIG. 1 is a schematic view of an extrusion process.

The accompanying figures and the description that follows set forth this invention in its preferred embodiments. However, it is contemplated that persons generally familiar with extrusion processes and/or molten metal supply systems will be able to apply the novel characteristics of the structures and methods illustrated and described herein in other contexts by modification of certain details. Accordingly, the figures and description are not to be taken as restrictive on the scope of this invention, but are to be understood as broad and general teachings. When referring to any numerical range of values, such ranges are understood to include each and every number and/or fraction between the stated range minimum and maximum. Finally, for purposes of the description hereinafter, the terms "upper", "lower", "right", "left", "vertical", "horizontal", "top", "bottom", and derivatives thereof shall relate to the invention, as it is oriented in the drawing figures.

The invention is directed to a pressurized molten metal supply system (continuous metal delivery system) incorporating at least two molten metal injectors. The molten metal supply system may be used to deliver molten metal to a downstream extrusion apparatus or process. In particular, the molten metal supply system disclosed in this invention provides molten metal at substantially constant flow rates and pressures to a downstream extrusion apparatus or process.

Figure 2:
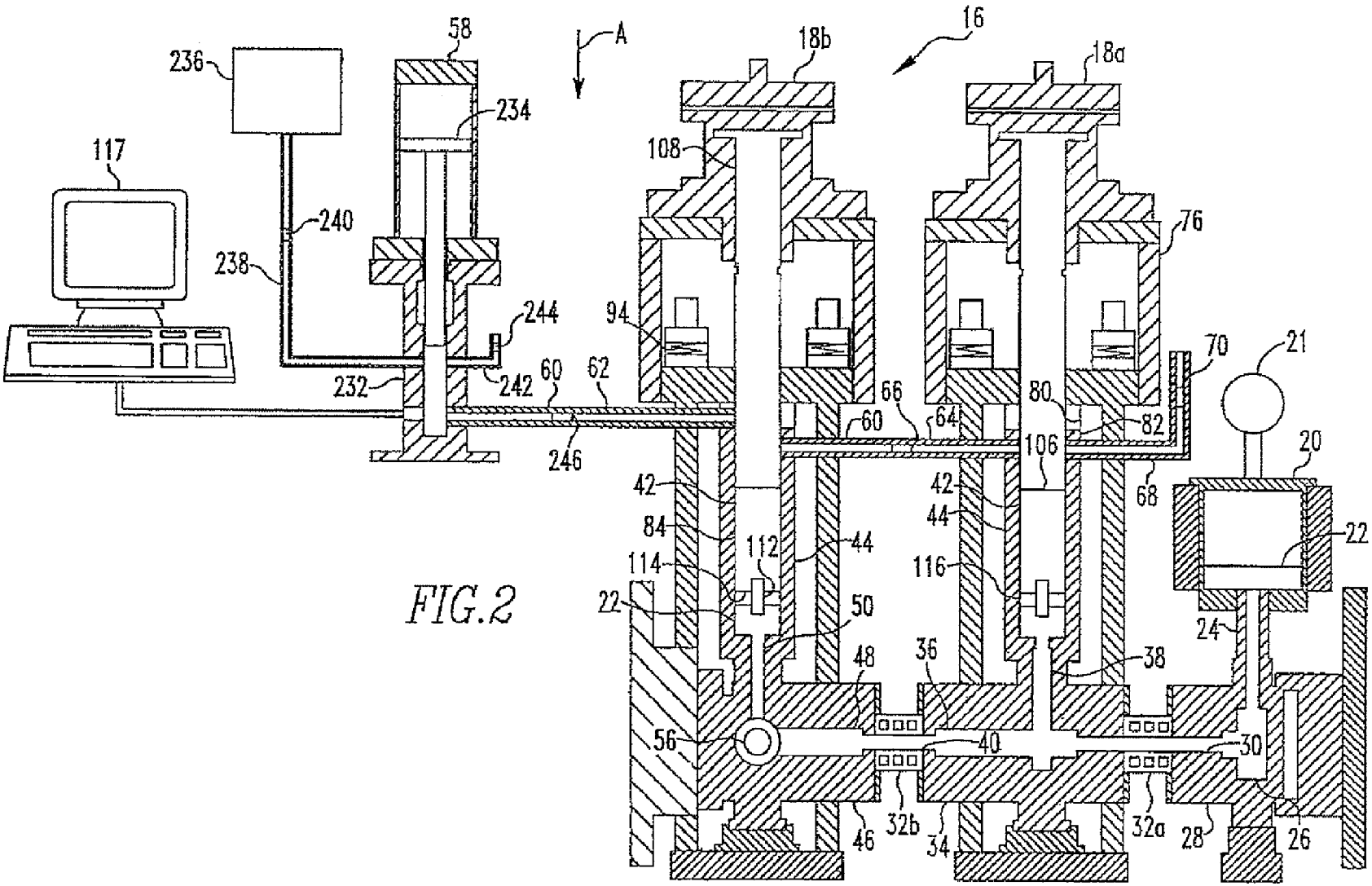
FIG. 2 is a schematic cross-sectional view of a molten metal supply system constructed and arranged in accordance with the invention.

As shown in FIG. 2, a molten metal supply system 16 includes a plurality of molten metal injectors 18 separately identified with "a" and "b" designations. A FC molten metal injector 18*a* and an AC molten metal injector 18*b* are identical and their component parts are described hereafter in terms of a single injector 18 for clarity. A low pressure feed system 20 provides molten metal 22 to FC molten metal injector 18*a*. Low pressure feed system 20 is continuously supplied with molten metal from a container 21 that is in fluid communication with the low pressure feed system 20. Low pressure feed system 20 is also in fluid communication with a substantially vertically extending first feeding passage 24. First feeding passage 24 is in fluid communication with a first receiving chamber 26, which is enclosed in a first housing 28. First receiving chamber 26 is in fluid communication with a substantially laterally extending second feeding passage 30. A check valve 32*a* can be used to either impede or facilitate the flow of molten metal 22 through the second feeding passage 30.

Second feeding passage 30 extends into a second housing 34 that encloses a second receiving chamber 36. Second receiving chamber 36 is in fluid communication with second feeding passage 30, a substantially vertically extending third feeding passage 38, and a substantially laterally extending fourth feeding passage 40. Third feeding passage 38 is in fluid communication with the interior 42 of an injector housing 44 of FC molten metal injector 18*a*. A (OCV) check valve 32*b*, is used to facilitate or impede the flow of molten metal 22 through fourth feeding passage 40. Even though FIG. 2 depicts check valves 32*a* and 32*b* as being positioned about the center of second and fourth feeding passages 30 and 40, first and/or second check valves 32*a* and 32*b* can also extend along substantially the entire length of second and fourth feeding passages 30 and 40, respectively.

Figure 8:
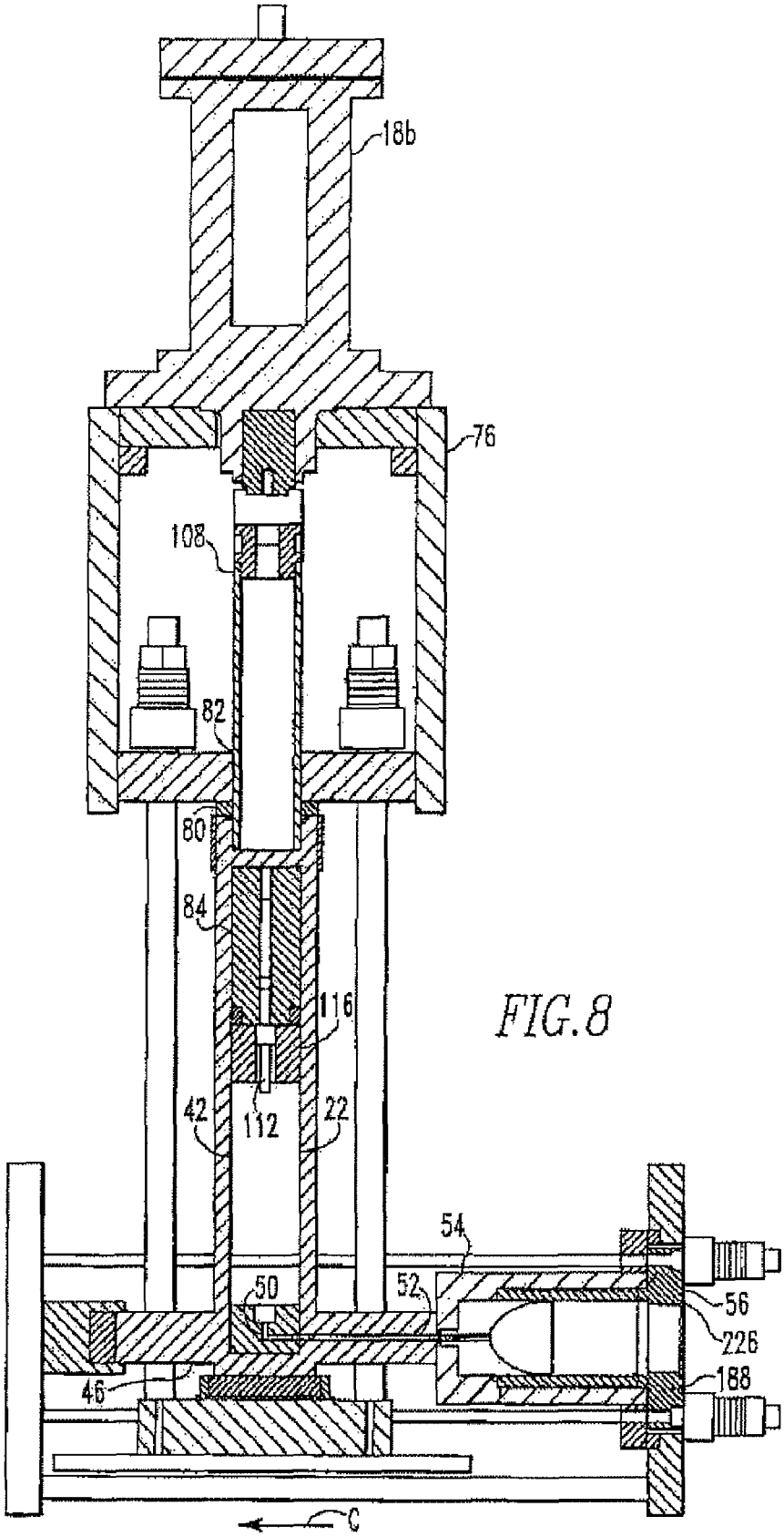
FIG. 8 is a longitudinal section of the molten metal supply system.

Fourth feeding passage 40 extends into a third housing 46 that encloses a third receiving chamber 48. Third receiving chamber 48 is in fluid communication with fourth feeding passage 40, a substantially vertically extending fifth feeding passage 50, and an outwardly extending sixth feeding passage 52 (as shown in FIG. 8). Fifth feeding passage 50 is in fluid communication with interior 42 of housing 44 of second injector 18*b*. Sixth feeding passage 52 is in fluid communication with an extrusion mold 54 (as shown in FIG. 8), which is used to solidify molten metal 22 before the molten metal 22 is extruded through an extrusion die 56 that is attached to extrusion mold 54. Even though FIG. 2 depicts feeding passages 24, 30, 38, 40, 50 and 52 as having substantially the same diameter, it is noted that this is not meant to be limiting since one or more of feeding passages 24, 30, 38, 40, 50 and 52 can have diameters of varying sizes.

As can be understood in FIG. 2, a process control cylinder 58, AC molten metal injector 18*b*, and FC molten metal injector 18*a* are joined by a gas conduit 60 that allows gas to be conducted between process control cylinder 58 and FC molten metal and AC molten metal injectors 18*a*, 18*b*. A gas pad 116 in FC molten metal injector 18*a* is replenished by gas that passes (travels) from AC molten metal injector 18*b* to FC molten metal injector 18*a* through gas conduit 60 that is located between FC molten metal and AC molten metal injectors 18*a*, 18*b*. Gas pad 116 of AC molten metal injector 18*b* is replenished by gas that passes from process control cylinder 58 to AC molten metal injector 18*b* through gas conduit 60 that is located between process control cylinder 58 and AC molten metal injector 18*b*. The function of gas conduit 60 will be described in further detail below.

In FIG. 2, process control cylinder 58 is in gas communication with AC molten metal injector 18*b* via a substantially laterally extending first gas conduit 62. A substantially laterally extending second gas conduit 64 connects AC molten metal injector 18*b* to FC molten metal injector 18*a*. Attached to second gas conduit 64 is a first gas valve 66, which is used to regulate the flow of gas between FC molten metal and AC molten metal injectors 11*a* and 18*b*. A third gas conduit 68 is attached to FC molten metal injector 18*a*. Third gas conduit 68 is used to vent (i.e. expel or release) gas from FC molten metal injector 18*a*. The venting operation is regulated by a second gas valve 70 that is attached to third gas conduit 68.

Figure 3:
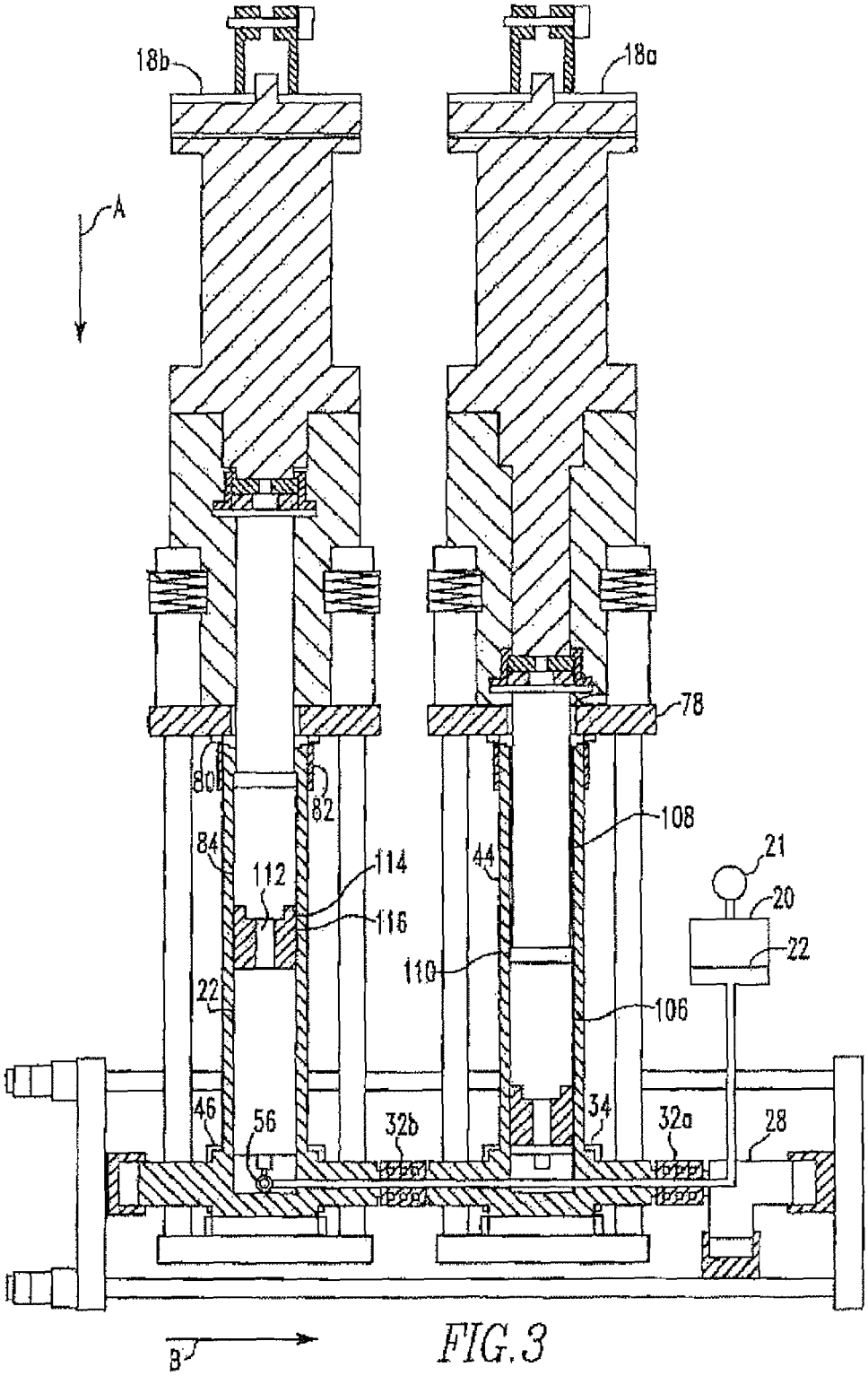
FIG. 3 is a cross-sectional view of a molten metal supply injector utilized in the system of FIG. 2.
Figure 4:
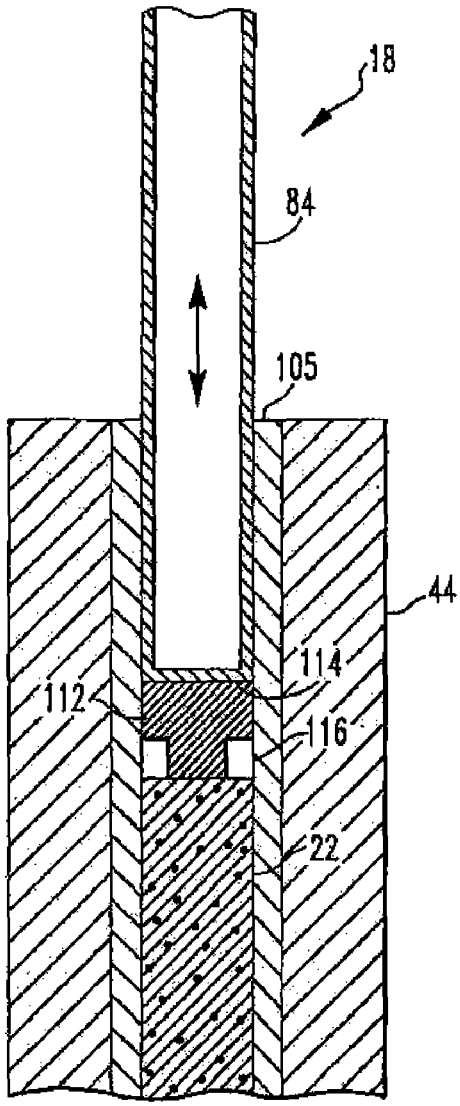
FIG. 4 is a schematic cross-sectional view of a molten metal injector.

FC molten metal injector and FC molten met injector 18*a* and 18*b* are identical and their component parts will be described hereinafter in terms of a single injector "18" for clarity. Referring to FIGS. 2-5, injector 18 includes an injector housing 44 that is used to contain molten metal 22 prior to the displacement of molten metal 22 to a downstream apparatus or process. In one embodiment of this invention, injector housing 44 is lined with graphite 105 (as shown in FIG. 4). This, however, is not meant to be limiting since the lining can be manufactured from any material that does not adversely react with molten metal 22 that is being used. A piston 84 extends downward into injector housing 44 and is reciprocally operable within injector housing 44. As seen in FIGS. 2-4, a first end 106 of the piston 84 is coupled to an hydraulic actuator or ram 108 that drives piston 84 through its reciprocal movement. First end 106 of piston 84 is coupled to an hydraulic actuator 108 by a self-aligning coupling 110. The height of gas pad 116, which is located between a second end 114 of piston 84 and molten metal 22 is conveyed to a computer or a control unit 117 (as shown in FIG. 2), which regulates the actuation of a process control cylinder (PCC) 58, FC molten metal injector 18*a*, and AC molten metal injector 18*b*. The actuation of injector piston 94 is such that a fixed gas pad height is maintained. The method in which computer 117 regulates the actuation of process control cylinder (PCC) 58, FC molten metal injector 18*a*, and AC molten metal injector 18*b* is described in further detail below.

Figure 5:
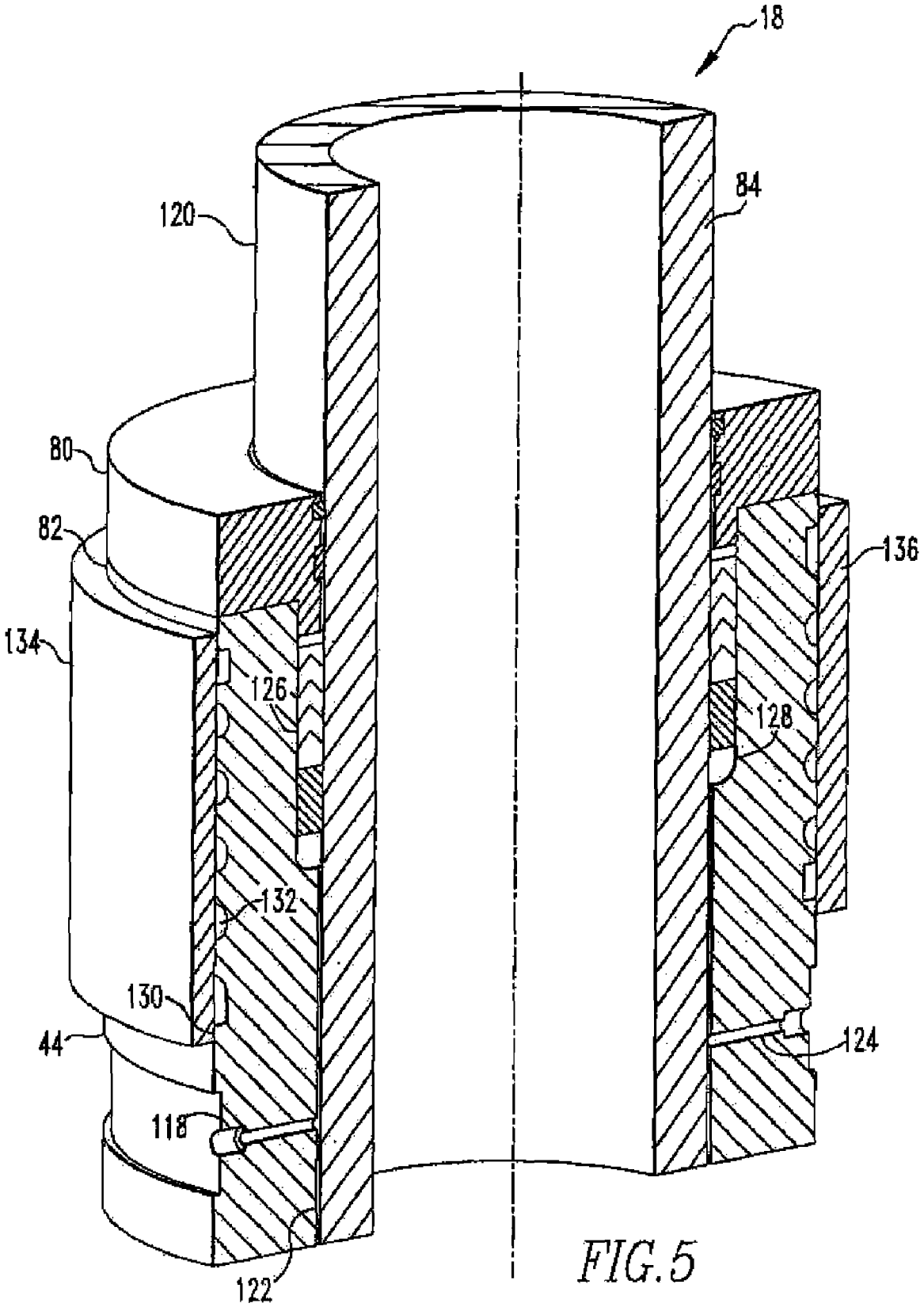
FIG. 5 is a cross-sectional view of a molten metal injector, seal, and means for cooling the seal in accordance with the invention.

Referring to FIG. 5, gas is introduced into FC and AC injectors 18*a* and 18*b*, respectively, by one or more gas inlet passages 118 that extend through injector housing 44. Gas inlet passage 118 is in gaseous communication with at least one adjacent injector (not shown) or with the process control cylinder (not shown). As can be clearly seen in FIG. 5, an outer surface 120 of piston 84 is not completely flush (i.e. in contact) with interior wall 122 of injector housing 18 thereby allowing gas from adjacent injectors or from the process control cylinder 58 to enter the injector housing 44. When a gas valve is opened, the gas exits injector housing 18 through one or more gas outlet passages 124 that extend through injector housing 44.

The gas in injector housing 44 is prevented from escaping between piston 84 and injector housing 44 by at least one seal 126 that is positioned in the vicinity of the first end 82 of injector housing 44. As can be clearly seen in FIG. 5, seal 126 is received into a groove 128 that is located within the interior wall 122 of the injector housing 44 adjacent to the outer surface 120 of the piston 84. Positioned adjacent to first end 82 of injector housing 44 is an annular shoulder 80, which is situated beneath the support housing 76 or the top plates 78.

Seal 126 is cooled to prevent degradation due to the heat that is generated by the molten metal 22, the heated gas in injector housing 44, and the friction that is caused by the actuation of piston 84. FIG. 5 depicts one embodiment of the cooling means that can be implemented. In this embodiment, a plurality of cooling channels 132 are positioned on the outer surface 130 of injector housing 44 in the vicinity of seal 126. A shell 134, which is designed to prevent the coolant from escaping from cooling channels 132, surrounds cooling channels and injector housing 44. In another embodiment, cooling channels are located within the interior 136 of shell 134.

Figure 6:
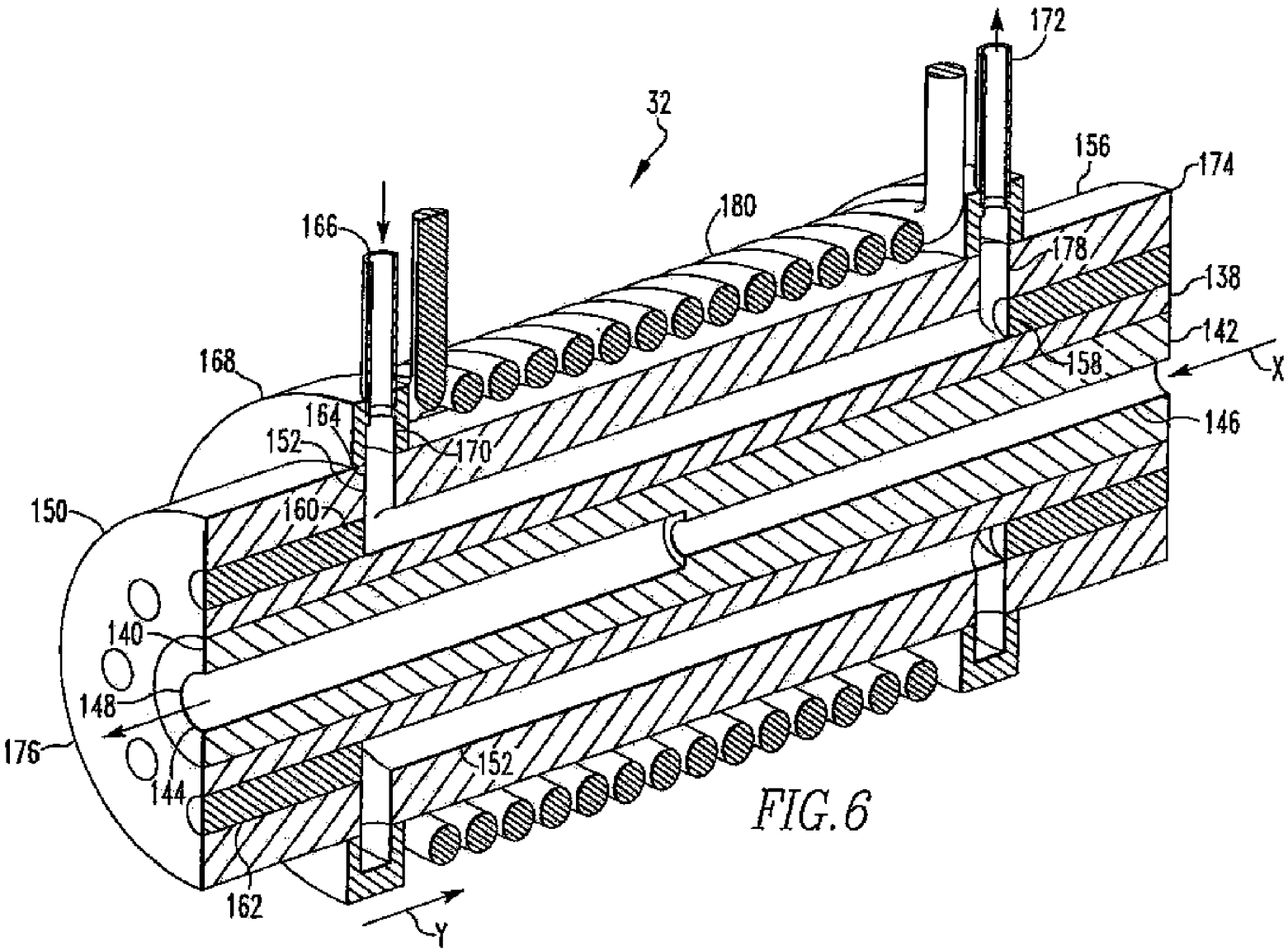
FIG. 6 is a cross-sectional view of a check valve used in the system of FIG. 2.
Figure 7:
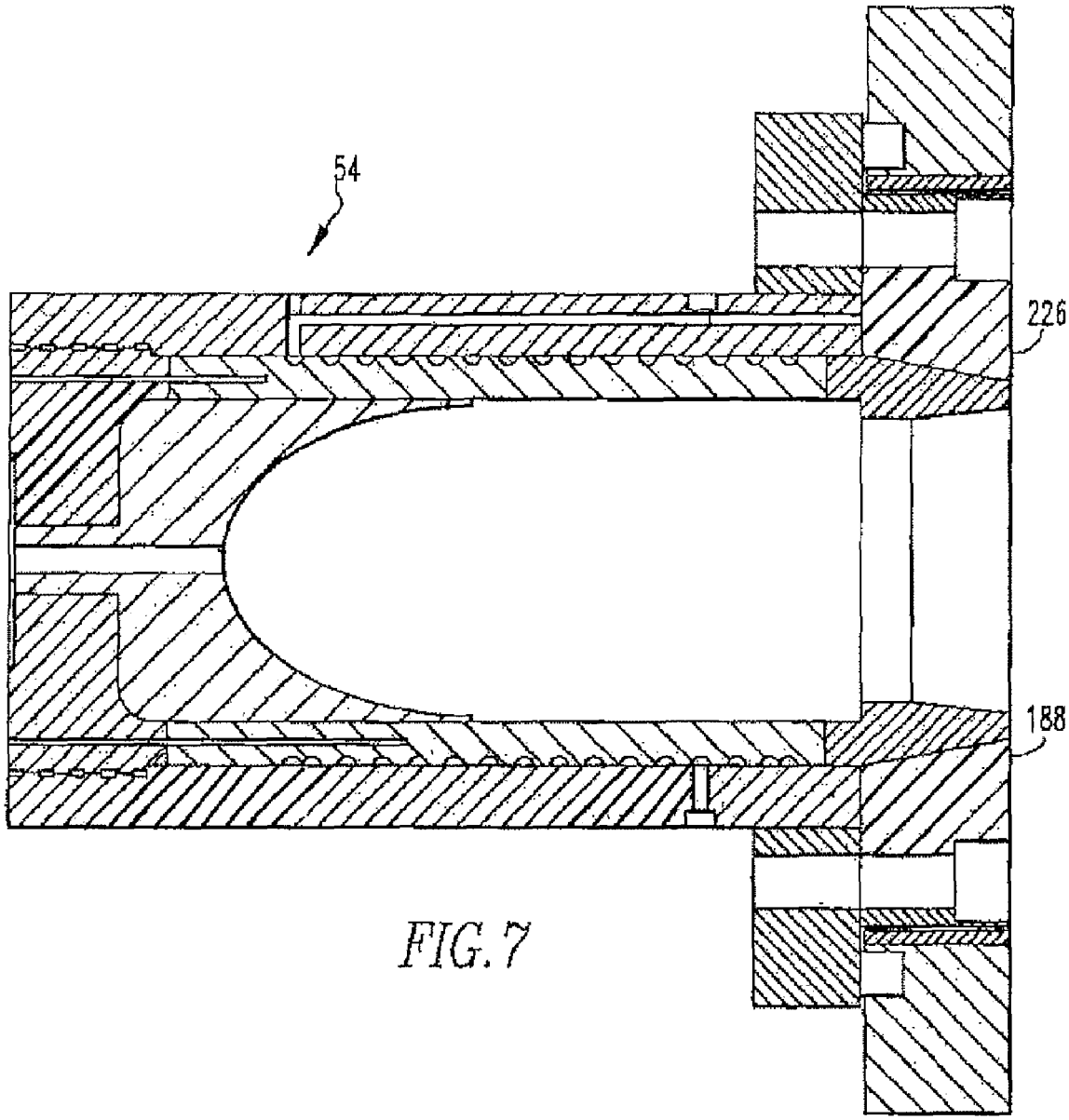
FIG. 7 is a cross sectional view of the extrusion mold.

As can be understood from FIGS. 2 and 6, the method of extrusion can be separated into two separate and distinct cycles. First, there is a fill cycle that prepares molten metal supply system 2 for the extrusion process. Once molten metal supply system 2 has been filled with molten metal 22, the extrusion cycle is initiated to extrude the product.

During the fill cycle, low pressure feed system 20 is filled with molten metal 22 from a container 21, which contains molten metal. Once low pressure feed system 20 is filled with molten metal 22, molten metal 22 travels from low pressure feed system 20 into first feeding passage 24, which is in fluid communication with first receiving chamber 26. The movement of molten metal 22 from low pressure feed system 20 to first feeding passage 24 is a result of the gas pressure in low pressure feed system 20 being higher (i.e. greater) than the gas pressure in FC molten metal injector 18*a*. Accordingly, molten metal 22 moves from low pressure feed system 20 to FC molten metal injector 18*a*. As molten metal 22 exits from low pressure feed system 20, additional molten metal 22 is introduced into low pressure feed system 20 via container 21 so that the height of molten metal 22 in low pressure feed system 20 remains substantially constant. From first receiving chamber 26, molten metal 22 travels into second feeding passage 30.

Molten metal 22 travels through second feeding passage 30 into second receiving chamber 36, which is in fluid communication with third and fourth feeding passages 38 and 40. At this particular moment, molten metal 22 is able to travel freely through second feeding passage 30 because ICV check valve 32*a* includes heating coils 180 that are active and are heating molten metal 22 to ensure that molten metal 22 remains in a substantially liquid state. As second receiving chamber 36 is filled with molten metal 22, molten metal 22 is prevented from traveling through the fourth feeding passage 40 by OCV check valve 32*b* that is being cooled in order to lower the temperature of molten metal 22 below a solidification temperature. Unlike ICV check valve 32*a*, heating coils 180 on OCV check valve 32*b* are inactive at this time. By preventing molten metal 22 from traveling through fourth feeding passage 40, second receiving chamber 36 is filled with molten metal 22. Once second receiving chamber 36 has been filled, molten metal 22 travels into third feeding passage 38, which is in fluid communication with interior 42 of injector housing 42 of the FC molten metal injector 18*a*. As the height of molten metal 22 in FC molten metal injector 18*a* rises, molten metal probe 116 transmits the distance between piston 84 and molten metal 22 to computer or control unit 117. Computer 117 instructs piston 84 of the FC molten metal injector 18*a* to move or actuate upward (i.e. return stroke) thereby maintaining a constant pre-determined height between piston 84 and molten metal 22.

When molten metal 22 in FC molten metal injector 18*a* reaches a critical height, the ICV is closed by removing the induction heating power and cooling the valve body substantially below the freezing point of aluminum. Gas pad in the FC cylinder is then pre-pressurized substantially close to gas pad pressure in AC molten metal injector 18*b*. Then the heating coils 180 of OCV check valve 32*b* are activated thereby raising the temperature of solidified molten metal 22 in OCV check valve 32*b* above the solidification temperature of molten metal 22. At the same time, the gas pressure between the FC molten metal and AC molten metal injectors 18*a* and 18*b*, respectively, are equalized by conducting gas from AC molten metal injector 18*b* through gas conduit 60 to AC molten metal injector 18*a* by opening first gas valve 66. The equalization of gas pressure causes the pressure in FC molten metal injector 18*a* to rise above the gas pressure in low pressure feed system 20 thereby preventing the flow of molten metal 22 from the low pressure feeds system 20 to FC molten metal injector 18*a*. Once above the solidification temperature, molten metal 22 in OCV check valve 32*b* travels through fourth feeding passage 40 into the third receiving chamber 36, which is in fluid communication with fifth and sixth feeding passages 50 and 52. While molten metal 22 begins to travel through the OCV check valve 32*b*, piston 84 of the FC molten metal injector 18*a* begins its downstroke (i.e. displacement stroke) at a pre-determined velocity. Computer 117 monitors the measurements that are taken by molten probe 112 and adjusts the speed of piston 84 to match the pre-determined velocity accordingly. The downstroke of EC molten metal injector's 18*a* piston 84 pushes molten metal 22 in injector housing 44 through third feeding passage 38, second receiving chamber 36, and into fourth feeding passage 40. During the downstroke of piston 84, backflow of molten metal 22 through second feeding passage 30 is prevented by cooling ICV check valve 32*a* and solidifying molten metal 22 located therein.

Once molten metal 22 is in third receiving chamber 48 molten metal 22 travels through both fifth and sixth feeding passages 50 and 52 simultaneously. Fifth feeding passage 50 is in fluid communication with interior 42 of injector housing 44 of the AC molten metal injector 15*b* while sixth feeding passage 52 is in fluid communication with extrusion mold 54. Injector housing 44 of AC molten metal injector 15*b* is filled the computer 117 moves piston 84 of AC molten metal injector 18*b* upward (i.e. return stroke) so that a constant predetermined height (i.e. gas pad 116) is maintained between piston 84 and molten metal 22.

The extrusion cycle is defined by FC molten metal injector 18*a* going through a displacement stroke followed by a return stroke. Daring the extrusion cycle piston 84 of AC molten metal injector is monitored by computer 117, which is programmed to maintain a pre-determined distance between piston 84 and molten metal 22. In other words, a constant gas pad 116 height is maintained at all times. This distance is measured by molten probe 112 and the measurements are transmitted to the computer 117 continuously. The downstroke of piston 84 of AC molten metal injector 18*b* displaces molten metal 22 in AC molten metal injector 18*b* to extrusion mold 54 via fifth feeding passage 50, third receiving chamber 48, and sixth feeding passage 52. Backflow of molten metal 22 through fourth feeding passage 40 is prevented by closing OCV check valve 32*b* by solidifying molten metal 22 that is located therein.

Referring to FIG. 8, once in extrusion mold 54 molten metal 22 is solidified and extruded through extrusion die 226, which is located at the second end 188 of extrusion mold 54. Means for measuring the velocity at which a solid extrusion exits extrusion die 226 is positioned downstream from extrusion die 226. The velocity detecting means is monitored by a computer (not shown) that regulates process control cylinder 58.

As described in the preceding paragraphs, process control cylinder 58 regulates the gas pressure in AC molten metal injector 18*b*. Referring to FIG. 2, process control cylinder 58 includes a separate housing 232 and a separate piston 234 that is reciprocally operable within housing 232. The actuation of second piston 234 will affect the gas pressure in AC molten metal injector 18*b* since process control cylinder 58 and AC molten metal injector 18*b* are in gaseous communication. A gas supply source 236 supplies additional gas to process control cylinder 58 if required. Gas supply source 236 and process control cylinder 53 are connected by a fourth gas conduit 238. In other words, gas supply source 236 and process control cylinder 58 are in gaseous communication with one another via fourth gas conduit 238. Attached to fourth gas conduit 238 is a third gas valve 240, which is used to regulate the flow of gas between gas supply source 236 and the process control cylinder 58. A fifth gas conduit 242 is attached to process control cylinder 58. Fifth gas conduit 242 is used to vent (i.e. expel or release) gas from process control cylinder 58. The gas is vented through fifth gas conduit 242 in order to reduce the amount of gas located in process control cylinder 58. The amount of gas vented through fifth gas conduit 242 is controlled by a fourth gas valve 244, which is attached to fifth gas conduit 242. A fifth gas valve 246 is attached to the first gas conduit 62 in order to regulate the flow of gas between process control cylinder 58 and AC molten metal injector 18*b*.

If the exit speed of extrusion is below a desired velocity, then computer 117 will instruct process control cylinder (PCC) piston 234 to move downward (displacement stroke) thereby increasing the amount of pressure that is applied to the gas in process control cylinder 58. In other words, when PCC piston 234 enters the displacement stroke the total pressure in molten metal supply system 16 is increased. The increased gas pressure in process control cylinder 58 translates into an increase in gas pressure in AC molten metal injector 18*b*, since the gas in process control cylinder 58 is being displaced into AC molten metal injector 18*b*. Because piston 84 in AC molten metal injector 18*b* is designed to maintain a particular height as measured by molten metal probe 112 between piston 84 and molten metal 22, the downstroke velocity of piston 84 will increase to compensate for the height of expanded gas pad.

If the exit speed of extrusion is above a desired velocity (i.e. rate), then computer 117 will instruct PCC piston 234 to move upward (return stroke) thereby reducing the amount of pressure that is applied to the gas in process control cylinder 58 and consequently in AC molten metal injector 18*b*. In other words, when second piston 234 enters the return stroke, the total pressure in molten metal supply system 16 is decreased. Since piston 84 of AC molten metal injector 18*b* is designed to maintain a constant gas pad 116 height (i.e. distance between piston 84 and molten metal 22) as measured by molten metal probe 112, the downstroke velocity piston 84 of AC molten metal injector 18*b* is reduced to compensate for the higher levels of molten metal 22 in injector housing 42.

If the exit speed of extrusion is at the desired velocity, then computer 117 will instruct second piston 234 to remain stationary. By keeping second piston 234 stationary, the amount of pressure that is applied to the gas in process control cylinder 58 and consequently in AC molten metal injector 18*b* would remain constant. In other words, the overall pressure in molten metal supply system 16 would not be increased or decreased. Accordingly, extrusion would exit extrusion die 226 at the desired velocity.

Before the completion of the downstroke of AC molten metal injector 18*b*, first gas valve 66, which prevents gas from AC molten metal injector 18*b* from entering FC molten metal injector 18*a*, is opened in order to equalize the gas pressure between FC molten metal and AC molten metal injectors 18*a* and 18*b*. Once the gas pressure has been equalized between FC molten metal and AC molten metal injectors 18*a* and 18*b* first gas valve 66 is closed and FC molten metal injector 18*a* begins its downstroke to fill AC molten metal injector 18*b* and extrusion mold 54 with molten metal 22. When the displacement stroke of FC molten metal injector 15*a* is complete, second gas valve 70 is opened to relieve the gas pressure that has accumulated in FC molten metal injector 18*a* thereby lowering the pressure of AC molten metal injector 18*a* below that of low pressure feed system 20. This causes low pressure feed system 20 to fill FC molten metal injector 18*a* with molten metal 22 and the extrusion cycle is repeated so that molten metal 22 is continuously extruded at a constant rate.

Check Valve

First and second check valves 32*a* and 32*b* are identical and their component parts will be described hereafter in terms of a single check valve 32. The successful operation of the molten metal delivery system may be accomplished by employing any reliable molten metal check valve. An example of such a check valve is a dual action valve described in the U.S. Pat. No. 6,739,485 by Sample et. al. A preferred embodiment of a check valve based on the freezing and thawing of molten metal in accordance with the invention is described in the paragraphs that follow.

Referring to FIG. 6, check valve 32 includes a thermally conducting first core 138 having a first end 140 and a second end 142 with a central bore 144 extending substantially along the entire length. In one embodiment, first core 138 is substantially cylindrical in shape. In another embodiment, the thermally conducting first core 138 is fabricated from graphite. This, however, is not meant to be limiting since first core 138 can be manufactured from any thermally conducting material so long as the material does not adversely react with molten metal 22. The flow of molten metal 22 through central bore 144 is represented by an arrow Y. As can be understood from FIG. 6, molten metal 22 enters first core 138 through first end 140 and exits first core 138 from second end 142. In FIG. 6, central bore 144 includes a smaller diameter first bore 146 and a larger diameter second bore 148. Smaller diameter first bore 146 makes it more difficult for molten metal 22 to flow in the direction of an arrow X. Even though FIG. 6 depicts first and second bore 146 and 148 of the core 138 as having substantially the same length, one skilled in the art would recognize that first and second bores 146 and 148 could have unequal lengths. In one embodiment, central bore 144 has a substantially uniform diameter.

Surrounding first core 138 is a first sleeve 150. In one embodiment, first sleeve 150 has a substantially cylindrical shape and is manufactured from a thermally conducting metallic material such as copper. One or more cooling channels 152 are positioned within the interior of first sleeve 150 and extends substantially along the length thereof. Cooling channel 152 can be positioned proximate to or distal from the outer surface 156 of first sleeve 150. Cooling channel 152, which has a first end 158 and a second end 160, is fabricated by drilling channel 152 through the entire length of first sleeve 150. Once fabricated, each open end of channel 152 are sealed with a plug 162 in order to prevent the coolant from escaping. The methods that are used to drill cooling channel 152 and to attach plug 162 to first sleeve 150 art known in the art. In one embodiment, the plugs are made from copper. This, however, this is not meant to be limiting since any metal or metal alloy could be used to fabricate the plugs.

In another embodiment, first sleeve 150 is fabricated from two metallic halves that are welded together. Because half of cooling channel 152 is machined into each metallic halt this particular embodiment eliminates the need for having to use plugs 162 to seal the ends of two cooling channels 152 since the cooling channels 152 do not extend along the entire length of the first sleeve 150. If more than two cooling channels 152 are utilized in check valve 32 of this embodiment, then cooling channels 152 will be drilled and plugged using techniques that are well known in the art.

As shown in FIG. 6, coolant is introduced into cooling channel 152 by an inlet conduit 164, which is in constant fluid or gas communication with the second end 160 of cooling channel 152. Inlet conduit 164 extends substantially radially from cooling channel 152 and receives cool coolant from a first inlet cooling tube 166, which is held in place by a bracket 168 that extends substantially along the circumference of the first sleeve 150. Bracket 168 has an interior channel 170 that is in continuous fluid or gas communication with first inlet cooling tube 166. Interior channel 170 of bracket 168 also extends substantially along the circumference of bracket 168 thereby conducting cool coolant to other cooling channels 152 that are located within first sleeve 150.

As coolant flows towards first end 158 of cooling channel 152, coolant absorbs heat that is being eliminated from molten metal 22 thereby solidifying or freezing molten metal 22 that is located within thermally conducting first core 139 by lowering the temperature of molten metal 22 below a solidification temperature. Referring to FIG. 6, heated coolant is expelled from first sleeve 150 through a first outlet cooling tube 172 that is located near first end 174 of first sleeve 150. Even though FIG. 6 depicts first inlet cooling tube 166 as being located near second end 176 of first sleeve 150 and first outlet cooling tube 172 as being located near first end 174 of first sleeve 150, the position of first inlet 166 and outlet cooling tubes 172 can be reversed without departing from the scope of this invention. Similar to first inlet cooling tube 166, first outlet cooling tube 172 is held in place by bracket 168 that extends substantially along the circumference of first sleeve 150. Bracket 168 has an interior channel 170 that is in constant fluid or gas communication with first outlet cooling tube 172 and outlet conduit 178, which is in fluid or gas communication with first end of the cooling channel 158. Interior channel 170 extends substantially along the circumference of bracket 168 thereby conducting the heated coolant that is expelled from the cooling tubes toward first outlet cooling tube 172.

The flow of the coolant through first sleeve 150 can be summarized as follows. However, for clarity the flow of coolant will be described in relation to cooling channel 152 that is located near the top of first sleeve 150 in FIG. 6. First, coolant is received into first inlet cooling tube 166. The coolant then flows from first inlet cooling tube 166 into internal channel 170 of bracket 168. From internal channel 170 the coolant flows into inlet conduit 164, which is connected to second end 160 of cooling channel 152. As coolant travels from second end 160 of cooling channel 152 toward first end 158 the coolant absorbs the heat that is generated by molten metal 22. Heated coolant then flows from first end 158 of cooling channel 152 into first outlet cooling tube 172 via outlet conduit 178 and internal channel 170 of bracket 168.

First sleeve 150 is surrounded by a heating coil 180, which provides heat to the thermally conducting first core 138 and first sleeve 150 thereby ensuring that molten metal 22 flows freely through check valve 32 by keeping molten metal 22 above a solidification temperature as molten metal 22 travels through first and second bores 146 and 148 of the thermally conducting first core 138. Heating coil 180 is also used to return molten metal 22 back to a molten state after molten metal 22 has been solidified or frozen. Even though FIG. 6 depicts heating coil 180 as being positioned between the two brackets 168, this figure is not meant to be limiting since heating coil 180 could also be positioned adjacent to both sides of the brackets 168.

The design of traditional flow control valves relies on opening and closing an orifice to achieve a certain flow rate given a pressure drop. In the aluminum industry, check valves are utilized to permit or prevent the flow of a molten metal into a given system. However, these traditional check valves are problematic when they are used to control the flow of molten aluminum under high pressure (i.e. ≧5,000 psi). Part of the problem stems from the molten aluminum's affinity to react with most materials that are used to fabricate traditional check valves. Another problem is caused by the inability of traditional check valves to maintain their shape or form at temperatures at or above about 670° C. (1238° F.) because the materials used to manufacture the check valves begin to soften at high temperatures (i.e. ≧670° C.). In other words, the materials used to fabricate traditional check valves lack dimensional stability at temperatures at or above about 670° C. (1238° F.). Furthermore, reliable operation of traditional check valve designs is prevented by contaminants that are found in the molten aluminum itself. These contaminants are often hard solid particles that prevent a traditional check valve from forming a complete mechanical seal, which ultimately results in a significant amount of leakage when the molten aluminum is under high pressure.

The benefit of using the check valve design that is disclosed in this invention is that it has the ability to operate under high pressure (i.e. ≧5,000 psi) and at high temperatures (i.e. ≧670° C.). Unlike traditional check valves, this check valve has no moving parts. Accordingly, the lifespan of this check valve is dramatically increased since most of the components that comprise the check valve are not subject to mechanical wear. Another benefit to this check valve is that it is insensitive to the contaminants that are sometimes found in molten aluminum since the check valve is not relying on a mechanical seal to prevent the flow of molten aluminum trough the check valve. Instead, the check valve that is described in this invention relies on freezing the molten aluminum that is located in the central bore to prevent the flow of the molten aluminum through the check valve. Yet another benefit to the design of the check valve that is disclosed in this invention is that it is easily fabricated because strict or close tolerances are not required in making the check valve that is disclosed in this invention.

One advantage of using the molten metal supply system that is disclosed in this invention is that the system increases the amount of metal recovered during an extrusion process. During a typical extrusion process, the head and the tail of the extruded product would have to be rejected and sawed off since the head of the extruded product would have physical attributes that are different from the rest of the product while the tail of the extruded product would have contaminants that are typically unsuitable for an end product.

As stated above, another advantage of using the molten metal supply system that is disclosed in this invention is that a product of indefinite or arbitrary length could be produced thereby eliminating the need of having to use a billet or ingot with a large cross-sectional area and the microstructural inhomogeneities that typically accompany such a billet. By foregoing the use of a billet or ingot with a large cross-sectional area, the product that is extruded using the molten metal supply system does not exhibit the microstructural inhomogeneities that would normally occur if a billet having a large cross-sectional area was used.

Another advantage is that an extrusion could be produced at a higher rate (i.e. higher throughput of metal) because of the faster solidification rate that is achieved while using this invention.

Yet another advantage of using the molten metal supply system that is disclosed in this invention is that shrinkage porosity in the extruded product can be avoided because the aluminum product is solidified under pressure. By eliminating or reducing the occurrence of shrinkage porosity, the product that is extruded through the molten metal supply system exhibits little to no cross-sectional reduction after being extruded. This is in stark contrast to conventional processing techniques (i.e. traditional extrusion methods), which require large cross-sectional reductions in the extruded product in order to compensate for the shrinkage porosity that typically forms at the ingot casting stage.

When a product is extruded using conventional extrusion methods, such as direct or indirect extrusion, the temperature of the product varies along the length of the product. For instance, during direct extrusion the temperature of the product increases due to the frictional heating of the billet or ingot. During indirect extrusion the temperature of the product can drop as the billet is cooled in the container. These temperature variations in the product, which occur normally during the use of traditional extrusion methods, make press quenching of the heat treatable product unreliable since the product tends to distort after the quenching process. In addition to the distortion, the physical properties of the product would also vary along the length of the product after the product is press quenched. Press quenching includes quenching by means of water, air, and gas such nitrogen or argon. The distortion in the product is caused by the interaction between the severe thermal action of the quenching process and the varying temperatures that are found along the length of the product. In contrast, the molten metal supply system allows for the extrusion of a product having a uniform temperature thereby allowing the heat treatable product to be press quenched more reliably. In other words, the product that is extruded using the molten metal supply system that is disclosed in this invention would have little to no distortion after the product is quenched because the entire length of the product would have a uniform temperature.

Another advantage of using the molten metal supply system is that it allows for the extrusion of high strength aluminum alloys that are not able to be extruded using conventional techniques and methods since these aluminum alloys cannot be cast into billets or stock. For instance, when a high strength alloy is cast into a billet, the billet typically cracks. Because these high strength heat treatable aluminum alloys cannot be cast into billets or stock they cannot be extruded using traditional techniques. However, these high strength aluminum alloys can be extruded using the molten metal supply system that is disclosed in this invention because the molten metal supply system eliminates the need of having a billet or stock to extrude a product because the product is extruded from molten aluminum.

Yet another advantage of is invention relates to the solubility of alloying elements in an aluminum alloy. The solubility of alloying elements in molten aluminum, changes with applied pressure. Accordingly, the solubility of these alloying elements could be increased by manipulating the pressure in the molten metal supply system thereby allowing for the extrusion of a high strength heat treatable aluminum alloy having higher strength than conventional high strength heat treatable aluminum alloys since greater supersaturation of alloying elements in the aluminum alloy is possible with this invention.

Having described the presently preferred embodiments, it is to be understood that the invention may be otherwise embodied within the scope of the appended claims.

What is claimed is:

1. A molten metal supply system comprising:

(a) a molten metal supply source; and (b) a plurality of molten metal injectors comprising at least a first molten metal injector, and at least a second molten metal injector, wherein the first molten metal injector is configured to alternate between being:

in a first instance, in fluid communication with the molten metal supply source, and in a second instance, in fluid communication with the second molten metal injector and a downstream process, wherein the second molten metal injector is configured to alternate between being:

in a first instance, in fluid communication with the first molten metal injector and the downstream process and in a second instance, in fluid communication with the downstream process, wherein each of the injectors comprises:

an injector housing configured to contain molten metal and a piston that is reciprocally operable within the injector housing;

wherein the piston of each injector housing is moveable through a return stroke and a forward stroke, wherein the return stroke allows the molten metal to be received into the injector housing; and wherein the forward stroke displaces the molten metal from the injector housing:

wherein the system is configured such that the forward stroke of the first molten metal injector simultaneously feeds the molten metal to both (1) the housing of the second molten metal injector and (ii) the downstream process, and wherein the system is configured such that the forward stroke of the second molten metal injector feeds the molten metal into the downstream process; and (c) a process control cylinder having:

a process control cylinder housing in gaseous communication with the second molten metal injector, the process control cylinder housing configured to contain a gas, and a process control cylinder piston, wherein the process control cylinder piston is reciprocally operable within the process control cylinder housing, wherein the process control cylinder piston is movable through a forward stroke and a return stroke, wherein the system is configured to control the exit speed of a product of the downstream process via the process control cylinder piston;

wherein the return stroke of the process control cylinder piston decreases the amount of pressure applied to the gas in the process control cylinder housing, which decreases the velocity of the forward stroke of the second molten metal injector, which decreases the exit speed of the product of the downstream process, wherein the forward stroke of the process control cylinder piston increases the amount of pressure applied to the gas in the second housing, which increases the exit speed of the product of the downstream process.

2. The molten metal supply system according to claim 1, wherein the forward stroke of each of the first and second molten metal injectors feed the molten metal to the downstream process at a rate to maintain continuous operation.

3. The molten metal supply system according to claim 1, wherein each of the injectors is in gas communication with at least one adjacent injector.

4. The molten metal supply system according to claim 3, further comprising a plurality of gas valves comprising at least a first gas valve positioned between the first molten metal injector and the second molten metal injector and a second gas valve positioned adjacent the first molten metal injector, each of the gas valves being in gaseous communication with at least one of the injectors wherein:

prior to the second molten metal injector completing the forward stroke the first gas valve is opened, during the return stroke of the second molten metal injector the first gas valve is closed;

during a displacement stroke of the first molten metal injector each of the first and second gas valves are closed; and when the first molten metal injector completes the down stroke the second gas valve is opened, during the return stroke of the first molten metal injector each of the first and second gas valves are closed.

5. The molten metal supply system according to claim 1, further comprising a gas pad located between the piston and the molten metal in the first molten metal injector.

6. The molten metal supply system according to claim 5, wherein the gas pad is argon or other suitable gas.

7. A molten metal supply system according to claim 1, wherein the molten metal supply system further comprises:

a plurality of check valves comprising at least a first check valve positioned between the first molten metal injector and the molten metal supply source and a second check valve positioned between the first and second molten metal injectors;

wherein the first check valve is open and the second cheek valve is closed during the return stroke of the first molten metal injector, the first check valve is closed and the second check valve is open during a displacement stroke of the first molten metal injector and during the return stroke of the second molten metal injector, the second cheek valve is closed during the forward stroke of the second molten metal injector, the first and second molten metal injectors being synchronized to move in substantially opposite directions.

8. The molten metal supply system according to claim 1, wherein the downstream process is an extrusion mold.

* * * * *